US008176702B2

(12) United States Patent
Adam

(10) Patent No.: US 8,176,702 B2
(45) Date of Patent: May 15, 2012

(54) MODULAR BLOCK SYSTEM

(76) Inventor: Paul Adam, Clive, IA (US)

( * ) Notice: Subject to any disclaimer, the term of this patent is extended or adjusted under 35 U.S.C. 154(b) by 1883 days.

(21) Appl. No.: 10/994,859

(22) Filed: Nov. 22, 2004

(65) Prior Publication Data

US 2006/0117697 A1 Jun. 8, 2006

(51) Int. Cl.
*E04C 3/30* (2006.01)

(52) U.S. Cl. ..... 52/575

(58) Field of Classification Search ..... 52/575, 52/574, 606

See application file for complete search history.

(56) References Cited

U.S. PATENT DOCUMENTS

| | | | | | |
|---|---|---|---|---|---|
| 2,810,946 | A | * | 10/1957 | Garnich | 425/308 |
| D319,885 | S | | 9/1991 | Blomquist et al. | D25/118 |
| D321,060 | S | | 10/1991 | Blomquist et al. | D25/118 |
| D341,215 | S | | 11/1993 | Blomquist et al. | D25/118 |
| 5,294,216 | A | | 3/1994 | Sievert | 405/286 |
| D352,789 | S | * | 11/1994 | Adam | D25/113 |
| 5,735,643 | A | * | 4/1998 | Castonguay et al. | 405/286 |
| 5,827,015 | A | | 10/1998 | Woolford et al. | 405/286 |
| 5,848,511 | A | * | 12/1998 | Scales | 52/606 |
| 6,149,352 | A | | 11/2000 | MacDonald | 405/284 |
| 6,447,213 | B1 | | 9/2002 | MacDonald | 405/284 |
| 6,637,981 | B2 | | 10/2003 | MacDonald | 405/284 |
| 7,062,885 | B1 | * | 6/2006 | Dickenson, Jr. | 52/293.3 |
| 2003/0009970 | A1 | * | 1/2003 | MacDonald et al. | 52/562 |

OTHER PUBLICATIONS

"straight." Dictionary.com Unabridged (v 1.1). Random House, Inc. Aug. 11, 2008. <Dictionary.com http://dictionary.reference.com/browse/straight>.*

U.S. Patent Application Publication No. US 2004/0037655, published Feb. 26, 2004.

Versa-Lok brochure (publication date unknown, but product existed prior to Nov. 22, 2004).

Rockwood Retaining Wall Systems, Inc. brochure (publication date unknown, but product existed prior to Nov. 22, 2004).

Pyzique Wall Systems, Inc. brochure (publication date unknown, but product existed prior to Nov. 22, 2004).

EP Henry Coventry Wall Plus brochure (publication date unknown, but products existed prior to Nov. 22, 2004).

Keystone Retaining Wall Systems Country Manor brochure (copyright date 2003).

* cited by examiner

*Primary Examiner* — Branon Painter
(74) *Attorney, Agent, or Firm* — David H. Chervitz

(57) ABSTRACT

A modular block system comprises a first block, a second block, a third block, a fourth block, and a capstone, the first block having a front face, a back face, a first side, a second side, a top, and a bottom, with the front face being wider than the back face and the first side being slanted from the front face toward the back face, the second block having a front face, a back face, a first side, a second side, a top, and a bottom, with the front face being wider than the back face and the first and second sides being slanted from the front face toward the back face, the third block having a front face, a back face, a first side, a second side, a top, and a bottom, with the front face being wider than the back face and the first side being slanted from the front face toward the back face, and the fourth block having a front face, a back face, a first side, a second side, a top, and a bottom, with the front face being wider than the back face and the first side and the second side being from the front face toward the back face.

20 Claims, 10 Drawing Sheets

MODULAR BLOCK SYSTEM

BACKGROUND OF THE INVENTION

This invention relates to a modular block system and more particularly to a modular block system for constructing a retaining wall or other similar landscaping structure.

Retaining wall structures and similar landscaping structures have been constructed from various materials. Examples of such materials include railroad ties, steel rods or bars, poured concrete, rocks, stones, and preformed concrete blocks. In recent years the preformed concrete blocks have been popular because such blocks can be mass produced and are relatively inexpensive. Additionally, such blocks are as durable as concrete and have various finishes, textures, and colors. Even though these blocks are relatively inexpensive, they typically require complex installations to construct various landscaping structures. Further, due to the weight of the blocks, they are sometimes difficult to carry or handle when constructing a landscaping structure. Frequent hand or finger injuries occur when handling these blocks. Additionally, more than one type or size of block is typically required to construct a structure. Homeowners and commercial landscapers will avoid using numerous blocks due to the difficulty encountered in building a landscaping project or structure unless there is a simple or easy way to construct structures using multiple blocks.

The present invention is designed to obviate and overcome many of the disadvantages and shortcomings associated with present wall blocks. In particular, the present invention is a modular block system that may be used to easily construct various landscaping structures. Moreover, the modular block system of the present invention can be employed to easily construct various complex landscaping structures.

SUMMARY OF THE INVENTION

In one form of the present invention, a modular block system comprising a first block, a second block, a third block, a fourth block, and a capstone, the first block having a front face, a back face, a first side, a second side, a top, and a bottom, with the front face being wider than the back face and the first side being slanted from the front face toward the back face, the second block having a front face, a back face, a first side, a second side, a top, and a bottom, with the front face being wider than the back face and the first and second sides being slanted from the front face toward the back face, the third block having a front face, a back face, a first side, a second side, a top, and a bottom, with the front face being wider than the back face and the first side being slanted from the front face toward the back face, and the fourth block having a front face, a back face, a first side, a second side, a top, and a bottom, with the front face being wider than the back face and the first side and the second side being from the front face toward the back face.

In another form of the present invention, a modular block system comprises a first block, a second block, a third block, a fourth block, and a capstone, the first block having a front face, a back face, a first side, a second side, a top, and a bottom, a first indicator formed in the top, with the front face being wider than the back face and the first side being slanted from the front face toward the back face, the second block having a front face, a back face, a first side, a second side, a top, and a bottom, a second indicator formed in the top, with the front face being wider than the back face and the first and second sides being slanted from the front face toward the back face, the third block having a front face, a back face, a first side, a second side, a top, and a bottom, a third indicator formed in the top, with the front face being wider than the back face and the first side being slanted from the front face toward the back face, and the fourth block having a front face, a back face, a first side, a second side, a top, and a bottom, a fourth indicator formed in the top, with the front face being wider than the back face and the first side and the second side being from the front face toward the back face.

In yet another form of the present invention, a modular block system comprises a first block, a second block, a third block, a fourth block, and a capstone, the first block having a front face, a back face, a first side, a second side, a top, and a bottom, an alignment groove spanning the first side, with the front face being wider than the back face and the first side being slanted from the front face toward the back face, the second block having a front face, a back face, a first side, a second side, a top, and a bottom, an alignment groove spanning the first side, with the front face being wider than the back face and the first and second sides being slanted from the front face toward the back face, the third block having a front face, a back face, a first side, a second side, a top, and a bottom, an alignment groove spanning the first side, with the front face being wider than the back face and the first side being slanted from the front face toward the back face, and the fourth block having a front face, a back face, a first side, a second side, a top, and a bottom, an alignment groove spanning the first side, with the front face being wider than the back face and the first side and the second side being from the front face toward the back face.

Another form of the present invention is a landscaping structure constructed from a modular block system comprising a first block, a second block, a third block, a fourth block, and a capstone, the first block having a front face, a back face, a first side, a second side, a top, and a bottom, with the front face being wider than the back face and the first side being slanted from the front face toward the back face, the second block having a front face, a back face, a first side, a second side, a top, and a bottom, with the front face being wider than the back face and the first and second sides being slanted from the front face toward the back face, the third block having a front face, a back face, a first side, a second side, a top, and a bottom, with the front face being wider than the back face and the first side being slanted from the front face toward the back face, and the fourth block having a front face, a back face, a first side, a second side, a top, and a bottom, with the front face being wider than the back face and the first side and the second side being from the front face toward the back face.

In light of the foregoing comments, it will be recognized that a principal object of the present invention is to provide a modular block system that is of simple construction and design and which can be easily employed with highly reliable results.

Another object of the present invention is to provide a modular block system that is easy to use to construct both residential and commercial landscaping projects or applications.

A further object of the present invention is to provide a modular block system that is capable of being manufactured using a mold with each mold being capable of producing two, four, or more modular blocks.

Another object of the present invention is to provide a modular block system that can be used to construct various landscaping structures such as retaining walls, fences, sitting walls, columns, and steps.

A still further object of the present invention is to provide a modular block system in which each of the blocks can be tumbled to present a natural or weathered appearance.

Another object of the present invention is to provide a modular block system that can be used to construct a mortarless retaining wall structure having courses interlocked in a predetermined set-back relationship in a variety of straight or curved configurations.

A still further object of the present invention is to provide a modular block system that has a designation on each of the modular blocks within the modular block system that can be used to easily construct various landscaping structures using installation instructions.

Another object of the present invention is to provide a modular block system in which two of the modular blocks within the modular block system may be used as a soldier stone.

These and other objects and advantages of the present invention will become apparent after considering the following detailed specification in conjunction with the accompanying drawings, wherein:

DETAILED DESCRIPTION OF THE PREFERRED EMBODIMENTS

Figure 1:
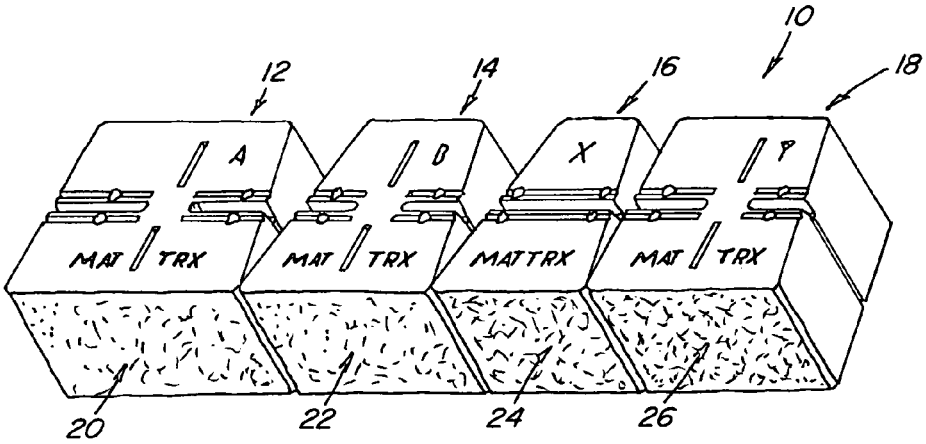
FIG. 1 is a perspective view of a preferred embodiment of a modular block system constructed according to the present invention.

Referring now to the drawings, wherein like numbers refer to like items, number 10 identifies a preferred embodiment of a modular block system constructed according to the present invention. With reference now to FIG. 1, the modular block system 10 has a first block 12, a second block 14, a third block 16, and a fourth block 18. The modular block system 10 also has a cap stone block (not shown) that will be described in detail further herein. The first block 12 has a front face 20, the second block 14 has a front face 22, the third block 16 has a front face 24, and the fourth block 18 also has a front face 26. All of the front faces 20, 22, 24, and 26 have an irregular or textured surface that resembles a natural product such as rock or stone and is known as a split face. The manner in which the split face is formed will be described herein. The front faces 20, 22, 24, and 26 are used to form an irregular shaped course, wall, or pattern that resembles a structure formed of natural rocks or stones.

Figure 2:
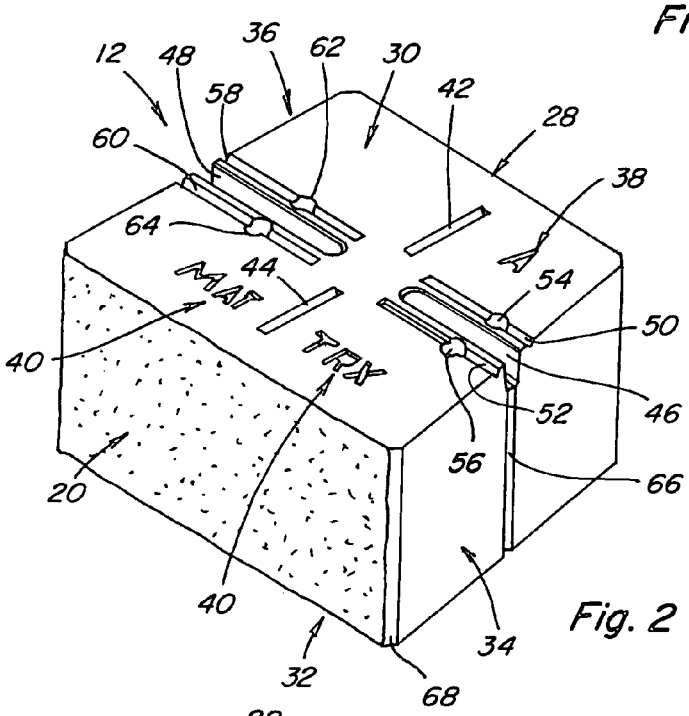
FIG. 2 is a perspective view of a first modular block of the modular block system constructed according to the present invention.

FIG. 2 shows a perspective view of the first block 12. The first block 12 has the front face 20, a back face 28, a top 30, a bottom 32, a first side 34, and a second side 36. The faces 20 and 28, the top 30, the bottom 32, and the sides 34 and 36 are used to form the first block 12. The top 30 has formed therein an indicator 38 to indicate which block in the modular block system 10 this particular block is. In this case, the first block 12 is referenced as being the "A" block in the modular block system 10. As can be appreciated, when constructing a structure using the modular block system 10, instructions may be included with the system 10 to show where to place this particular block 12. Also formed in the top 30 of the first block 12 is a marking 40 that shows the name of the modular block system 10.

The top 30 has a pair of score lines or recesses 42 and 44 that are used to split the block 12 into two separate blocks. The score lines 42 and 44 allow the block 12 to be split into two blocks with the score lines 42 and 44 being centered on the wider or front face 20. The top 30 also has a pair of offset pockets 46 and 48 formed therein. The offset pockets 46 and 48 are used to construct a retaining wall structure in a tiered formation with each tier being setback or offset from each other. The pockets 46 and 48 provide for a predetermined or preselected distance that each of the tiers will be setback. On each side of the pocket 46 is a pair of shallow grooves 50 and 52. Within the groove 50 is a passage 54 and within the groove 52 is a passage 56. The passages 54 and 56 may extend the entire height of the block 12. The passages 54 and 56 are adapted to receive rods or pins for use in constructing a landscaping structure. Further, on each side of the pocket 48 is another pair of grooves 58 and 60. Again, within the groove 58 is a passage 62 and within the groove 60 is a passage 64. The passages 62 and 64 may extend the entire height of the block 12. The block 12 also has an alignment groove 66 along the first side 34 centered on the pocket 46. Although not shown, there is an alignment groove on the second side 36 centered with the pocket 48. The alignment groove 66 is used to align or offset the blocks 12, 14, 16, and 18 when constructing a structure using the modular block system 10.

Figure 3:
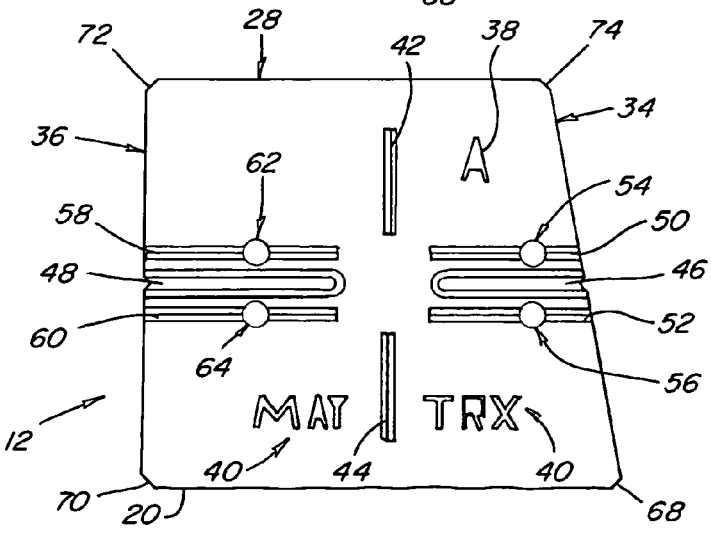
FIG. 3 is a top view of the first modular block shown in FIG. 2.

With reference now to FIG. 3, a top view of the block 12 is illustrated. The block 12 is shown to have the front face 20 being wider or longer than the back face 28. This is due to the first side 34 being slanted back toward the back face 28. Also, the second side 36 is not slanted at all, but is straight from the front face 20 to the back face 28. The block 12 also has beveled corners 66, 70, 72, and 74. The reason the corners 66, 70, 72, and 74 are beveled is to prevent the block 12 from being broken or chipped during manufacturing, transportation, storage, or handling. Although not shown in this particular illustration, the back face 28 also has a split face surface.

The block 12 is also depicted having the indicator 38 and the marking 40 formed in the top 30. The score lines 42 and 44 are parallel to the second side 36. The score lines 42 and 44 only span a portion of the top 30. The top 30 also has the pair of offset pockets 46 and 48 formed therein and the grooves 50, 52, 58, and 60, and the passages 54, 56, 62, and 64.

Figure 4:
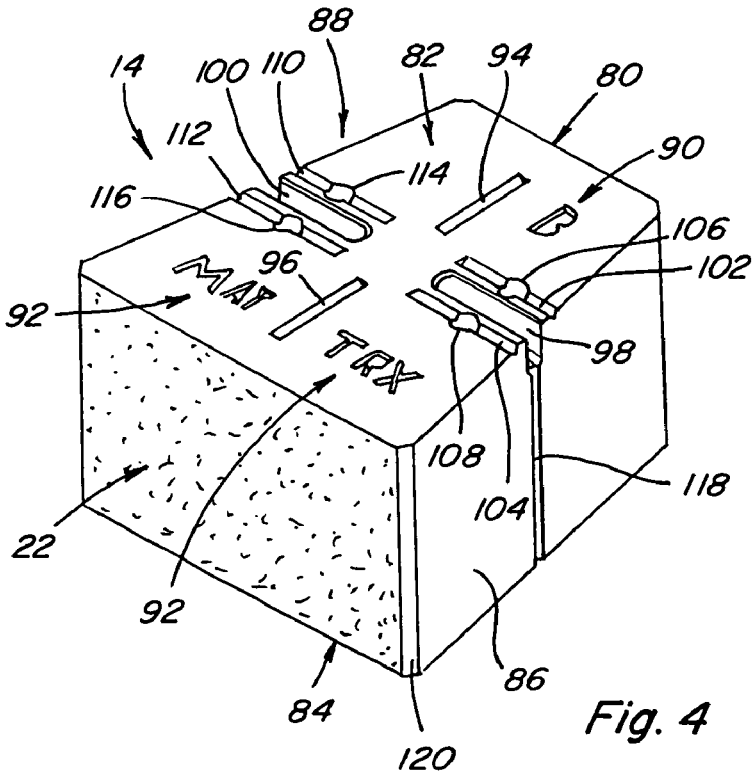
FIG. 4 is a perspective view of a second modular block of the modular block system constructed according to the present invention.

FIG. 4 illustrates a perspective view of the second block 14. The second block 14 has the front face 22, a back face 80, a top 82, a bottom 84, a first side 86, and a second side 88. The faces 22 and 80, the top 82, the bottom 84, and the sides 86 and 88 are used to form the second block 14. The top 82 has formed therein an indicator 90 to indicate which block in the modular block system 10 this particular block is. In this case, the second block 14 is referenced as being the "B" block in the modular block system 10. As can be appreciated, when constructing a structure using the modular block system 10, instructions may be included with the system 10 to show where to place this particular block 14. Also formed in the top 82 of the second block 14 is a marking 92 that shows the name of the modular block system 10.

The top 82 has a pair of score lines or recesses 94 and 96 that may be used to split the block 14 into two separate blocks. The score lines 94 and 96 allow the block 14 to be split into two blocks with the score lines 94 and 96 being centered on the wider or front face 22. The top 82 also has a pair of offset pockets 98 and 100 formed therein. The offset pockets 98 and 100 are used to construct a retaining wall structure in a tiered formation with each tier being setback or offset from each other. The pockets 98 and 100 provide for a predetermined or preselected distance that each of the tiers will be setback. On each side of the pocket 98 there is formed in the top 82 a pair of grooves 102 and 104. Within the groove 102 is a passage 106 and within the groove 104 is a passage 108. The passages 106 and 108 may extend the entire height of the block 14. The passages 106 and 108 are adapted to receive rods or pins for use in constructing a landscaping structure. The offset pocket 100 also has a pair of grooves 110 and 112 on each side. The groove 110 has a passage 114 and the groove 112 has a passage 116. The passages 114 and 116 may extend the entire height of the block 14. The block 14 also has an alignment groove 118 along the first side 86 centered on the pocket 98. Although not shown, there is an alignment groove on the second side 88 centered with the pocket 100. The alignment groove 118 is used to align or offset the blocks 12, 14, 16, and 18 when constructing a structure using the modular block system 10.

Figure 5:
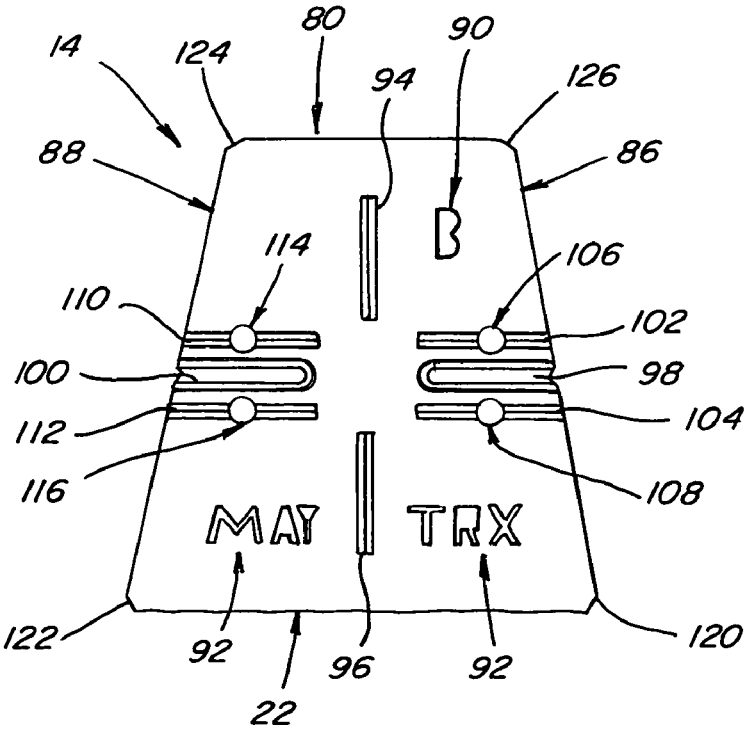
FIG. 5 is a top view of the second modular block shown in FIG. 4.

Referring now to FIG. 5, a top view of the second block 14 is illustrated. The block 14 is shown to have the front face 22 being wider or longer than the back face 80. This is due to the first side 86 and the second side 88 being slanted back toward the back face 80. The second block 14 is generally trapezoidal in shape. The block 14 also has beveled corners 120, 122, 124, and 126. The reason the corners 120, 122, 124, and 126 are beveled is to prevent the second block 14 from being broken or chipped during manufacturing, transportation, storage, or handling. Although not shown in this particular illustration, the back face 80 also has a split face surface.

The second block 14 is also depicted having the indicator 90 and the marking 92 formed in the top 82. The score lines 94 and 96 are centered on the top 82 of the block 14. The score lines 94 and 96 only span a portion of the top 82. The top 82 also has the pair of offset pockets 98 and 100, the grooves 102, 104, 110, and 112, and the passages 106, 108, 114, and 116 formed therein.

Figure 6:
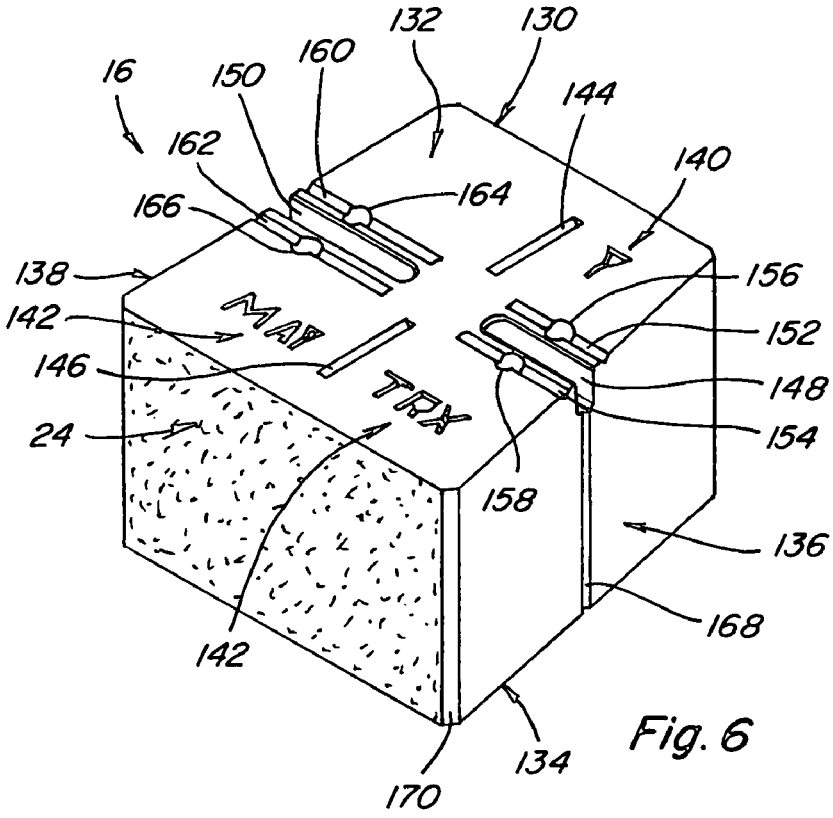
FIG. 6 is a perspective view of a third modular block of the modular block system constructed according to the present invention.

FIG. 6 shows a perspective view of the third block 16. The third block 16 has the front face 24, a back face 130, a top 132, a bottom 134, a first side 136, and a second side 138. The faces 24 and 130, the top 132, the bottom 134, and the sides 136 and 138 are used to form the third block 16. The top 132 has formed therein an indicator 140 to indicate which block in the modular block system 10 this particular block is. In this case, the third block 16 is referenced as being the "Y" block in the modular block system 10. As can be appreciated, when constructing a structure using the modular block system 10, instructions may be included with the system 10 to show where to place this particular block 16. Also formed in the top 132 of the third block 16 is a marking 142 that shows the name of the modular block system 10.

The top 132 has a pair of score lines or recesses 144 and 146 that are used to split the block 16 into two separate blocks. The score lines 144 and 146 allow the block 16 to be split into two blocks with the score lines 144 and 146 being centered on the wider or front face 24. The top 132 also has a pair of offset pockets 148 and 150 formed therein. The offset pockets 148 and 150 are used to construct a retaining wall structure in a tiered formation with each tier being setback or offset from each other. The pockets 148 and 150 are employed to act as a setback for each tier with the setback being at a predetermined or preselected distance. The offset pocket 148 has a pair of grooves 152 and 154 on opposite sides of the pocket 148. A passage 156 is positioned within the groove 152 and a passage 158 is located within the groove 154. On each side of the pocket 150 is a pair of grooves 160 and 162. Within the groove 160 is a passage 164 and within the groove 162 is a passage 166. The passages 156, 158, 164, and 166 may extend the entire height of the block 16. The passages 156, 158, 164, and 166 are adapted to receive rods or pins for use in constructing a landscaping structure. The block 16 also has an alignment groove 168 along the first side 136 centered on the pocket 148. Although not shown, there is an alignment groove on the second side 138 centered with the pocket 150. The alignment groove 168 is used to align or offset the blocks 12, 14, 16, and 18 when constructing a structure using the modular block system 10.

Figure 7:
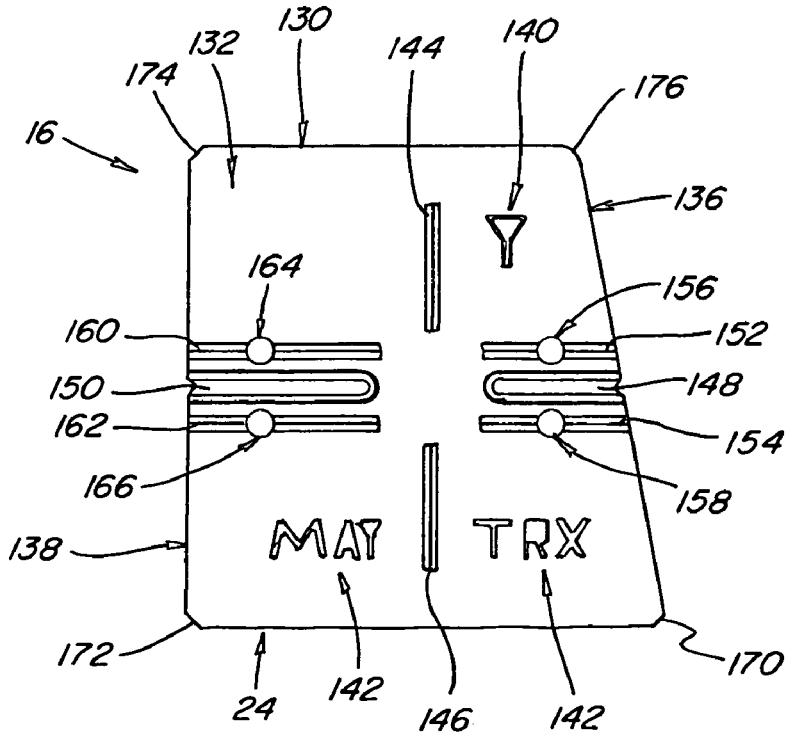
FIG. 7 is a top view of the third modular block shown in FIG. 6.

FIG. 7 illustrates a top view of the block 16. The block 16 is shown to have the front face 24 being wider or longer than the back face 130. This is due to the first side 136 being slanted back toward the back face 130. The second side 138 is not slanted at all, but is straight from the front face 24 to the back face 130. The block 16 also has beveled corners 170, 172, 174, and 176. The corners 170, 172, 174, and 176 are beveled to prevent the block 16 from being broken or chipped during manufacturing, transportation, storage, or handling. Although not shown in this particular illustration, the back face 130 also has a split face surface.

The block 16 is also depicted having the indicator 140 and the marking 142 formed in the top 132. The score lines 144 and 146 are parallel to the second side 138. The score lines 144 and 146 only span a portion of the top 132. The top 132 also has the pair of offset pockets 148 and 150, the grooves 152, 154, 160, and 162, and the passages 156, 158, 164, and 166 formed therein. The block 16 is generally smaller in some dimensions than the block 12.

Figure 8:
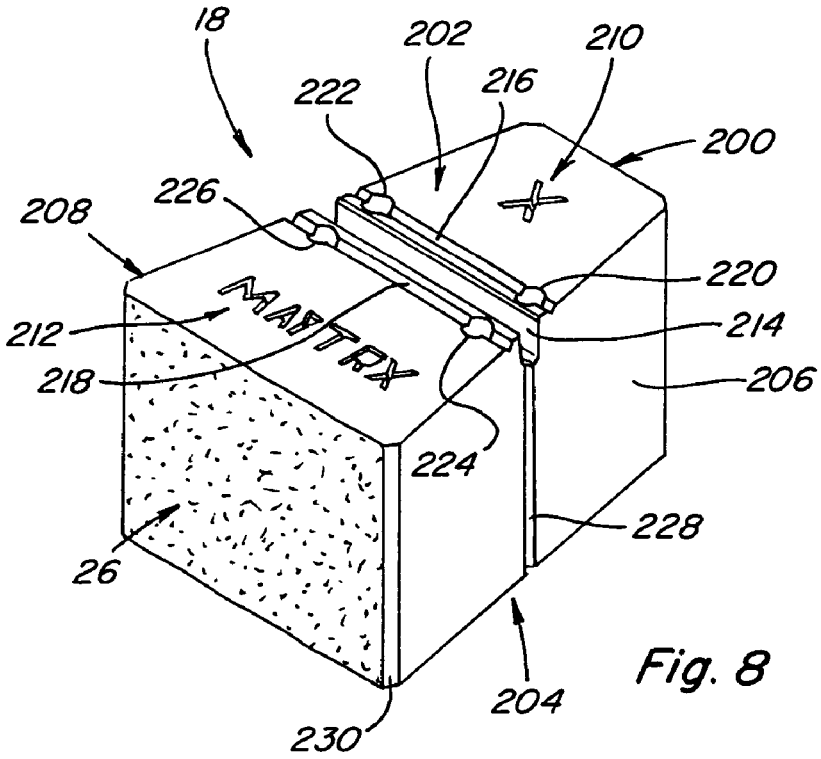
FIG. 8 is a perspective view of a fourth modular block of the modular block system constructed according to the present invention.

FIG. 8 illustrates a perspective view of the fourth block 18. The fourth block 18 has the front face 26, a back face 200, a top 202, a bottom 204, a first side 206, and a second side 208. The faces 26 and 200, the top 202, the bottom 204, and the sides 206 and 208 are used to form the fourth block 18. The top 202 has formed therein an indicator 210 to indicate which block in the modular block system 10 this particular block is. In this case, the fourth block 18 is referenced as being the "X" block in the modular block system 10. As can be appreciated, when constructing a structure using the modular block system 10, instructions may be included with the system 10 to show where to place this particular block 18. Also formed in the top 202 of the fourth block 18 is a marking 212 that shows the name of the modular block system 10.

The top 202 has an offset pocket 214 that spans the entire length of the top 202. The offset pocket 214 may be used to setback the block 18 when constructing a retaining wall structure. On each side of the pocket 214 there is formed in the top 202 a pair of grooves 216 and 218. Within the groove 216 are a pair of passages 220 and 222 and within the groove 218 are a pair of passages 224 and 226. The passages 220, 222, 224, and 226 may extend the entire height of the block 18. The passages 220, 222, 224, and 226 are used to receive rods or pins for use in constructing a landscaping structure. The block 18 also has an alignment groove 228 along the first side 206 centered on the pocket 214. Although not shown, there is an alignment groove on the second side 208 centered with the pocket 214. The alignment groove 228 is used to align or offset the blocks 12, 14, 16, and 18 when constructing a structure using the modular block system 10.

Figure 9:
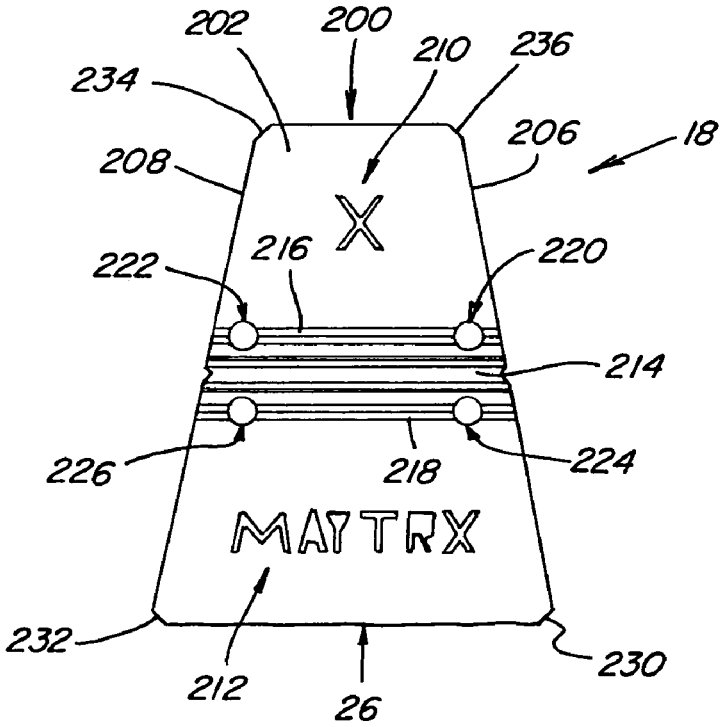
FIG. 9 is a top view of the fourth modular block shown in FIG. 8.

With particular reference now to FIG. 9, there is depicted a top view of the fourth block 18. The block 18 is shown to have the front face 26 being wider or longer than the back face 200. This is due to the first side 206 and the second side 208 being slanted back toward the back face 200. The fourth block 18 is generally trapezoidal in shape. The block 18 also has beveled corners 230, 232, 234, and 236. Again, the corners 230, 232, 234, and 236 are beveled to prevent any damage to the fourth block 18 during manufacturing, transportation, storage, or handling. Although not shown in this particular illustration, the back face 200 also has a split face surface. The fourth block 18 does not include any score lines and the block 18 is not intended to be split into two. The fourth block 18 is smaller in some dimension as compared to the second block 14.

Figure 10:
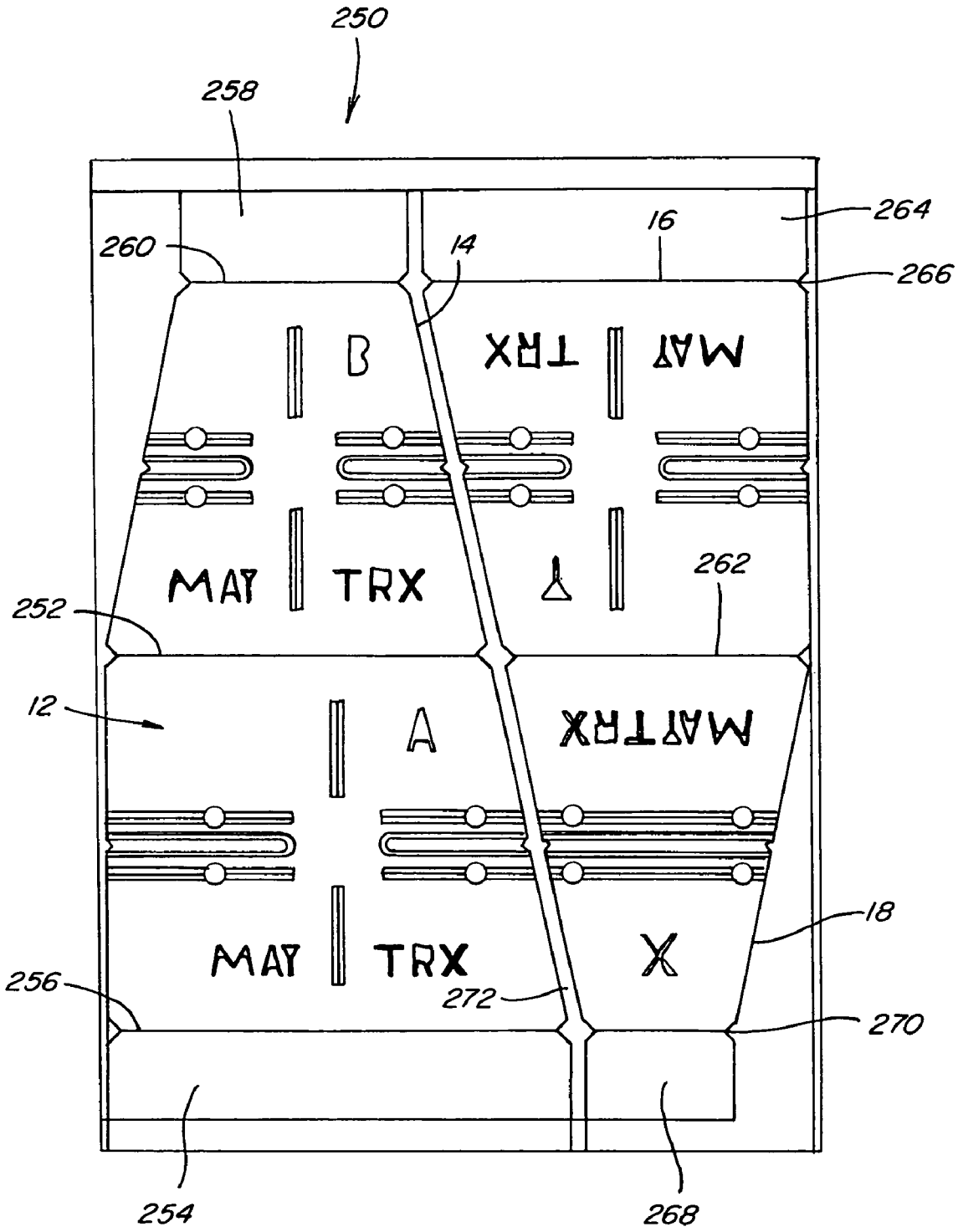
FIG. 10 is a top view of a mold box having the first, second, third, and fourth blocks and pavers formed therein.

FIG. 10 shows a mold box 250 that has the first block 12, the second block 14, the third block 16, and the fourth block 18 formed therein. The mould box 250 is generally rectangular in shape and may have dimension of 26 inches by 18½ inches. The first block 12 and the second block 14 are formed together at a junction or score line 252. The blocks 12 and 14 may be split apart from each other to form the split faces 20 and 22. Also, the first block 12 may have the back face 28 formed by splitting a paver 254 at a junction or score line 256. Splitting a paver 258 at a score line 260 forms the back face 80 of the second block 14. The third block 16 and the fourth block 18 are initially formed together at a score line 262. Once the third block 16 and the fourth block 18 are separated along the score line 262, the split faces 24 and 26 are formed. The back face 130 of the third block 16 is formed by splitting a paver 264 along a score line 266. Finally, the fourth block 18 is completed by splitting a paver 268 along a score line 270. The pavers 254, 258, 264, and 268 may be used for other landscaping projects and do not need to be discarded. The first block 12 and the second block 14 and the third block 16 and the fourth block 18 are not connected together during the manufacturing process. There is a gap 272 between the first block 12 and the second block 14 and the third block 16 and the fourth block 18.

As can be appreciated, the blocks 12, 14, 16, and 18 along with the pavers 254, 258, 264, and 268 of the present invention are formed in the mold box 250. Generally, the process entails molding the blocks 12, 14, 16, and 18 and the pavers 254, 258, 264, and 268 by using a mixture of cement and water and other materials. The blocks 12, 14, 16, and 18 and the pavers 254, 258, 264, and 268 are fabricated by compressing and vibrating the mixture in the mold box 250 by the application of pressure to the mixture by use of a block machine or similar machine. It is also known to use a press head having a press plate for applying pressure to the mold box 250. Further, the press plate may include structure that forms the shallow grooves, the indicators, and the markings in each of the blocks 12, 14, 16, and 18. Also, an insert bar may be used to form the passages and the offset pockets in each of the blocks 12, 14, 16, and 18. Once the blocks 12, 14, 16, and 18 and the pavers 254, 258, 264, and 268 are formed they may be cured through any method known in the art. For example, curing may take the form of air curing for a number of days or steam curing, but normally one day is allowed or needed for cure. Once cured, the blocks 12, 14, 16, and 18 along with the pavers 254, 258, 264, and 268 may be formed by splitting along the score lines 252, 256, 260, 262, 266, and 268. Some methods of splitting include using a manual chisel and hammer, a hydraulic splitting machine, or any other machine that can accomplish splitting. The score lines 252, 256, 260, 262, 266, and 268 provide a weak point that facilitates the splitting of the blocks 12, 14, 16, and 18 and the pavers 254, 258, 264, and 268. Additionally, splitting creates the split face surfaces 20, 22, 24, 26, 28, 80, 130, and 200 that resemble or mimic some types of natural stone or rock.

Many combinations of concrete mixtures may be employed in manufacturing the blocks 12, 14, 16, and 18 and the pavers 254, 258, 264, and 268. Some considerations in determining the particular concrete mixtures include compression strength requirements, density, and adsorption. Further, the costs of the materials, such as sand, gravel, cement, pigment additives, and rock have an impact on the mixture to be used. For example, gravel may be cheaper than river rock in some areas of the country and the blocks 12, 14, 16, and 18 and the pavers 254, 258, 264, and 268 may be formed of a mixture having more gravel than rock due to the difference in cost. The blocks 12, 14, 16, and 18 and the pavers 254, 258, 264, and 268 may be constructed with colored pigments to form different colored blocks. It should be recognized that the blocks 12, 14, 16, and 18 and the pavers 254, 258, 264, and 268 of the present invention may be constructed of various materials which are available. Preferably, the blocks 12, 14, 16, and 18 and the pavers 254, 258, 264, and 268 will be of relatively lightweight so that the blocks 12, 14, 16, and 18 and the pavers 254, 258, 264, and 268 can be easily manufactured, stored, transported, and stacked.

Figure 11:
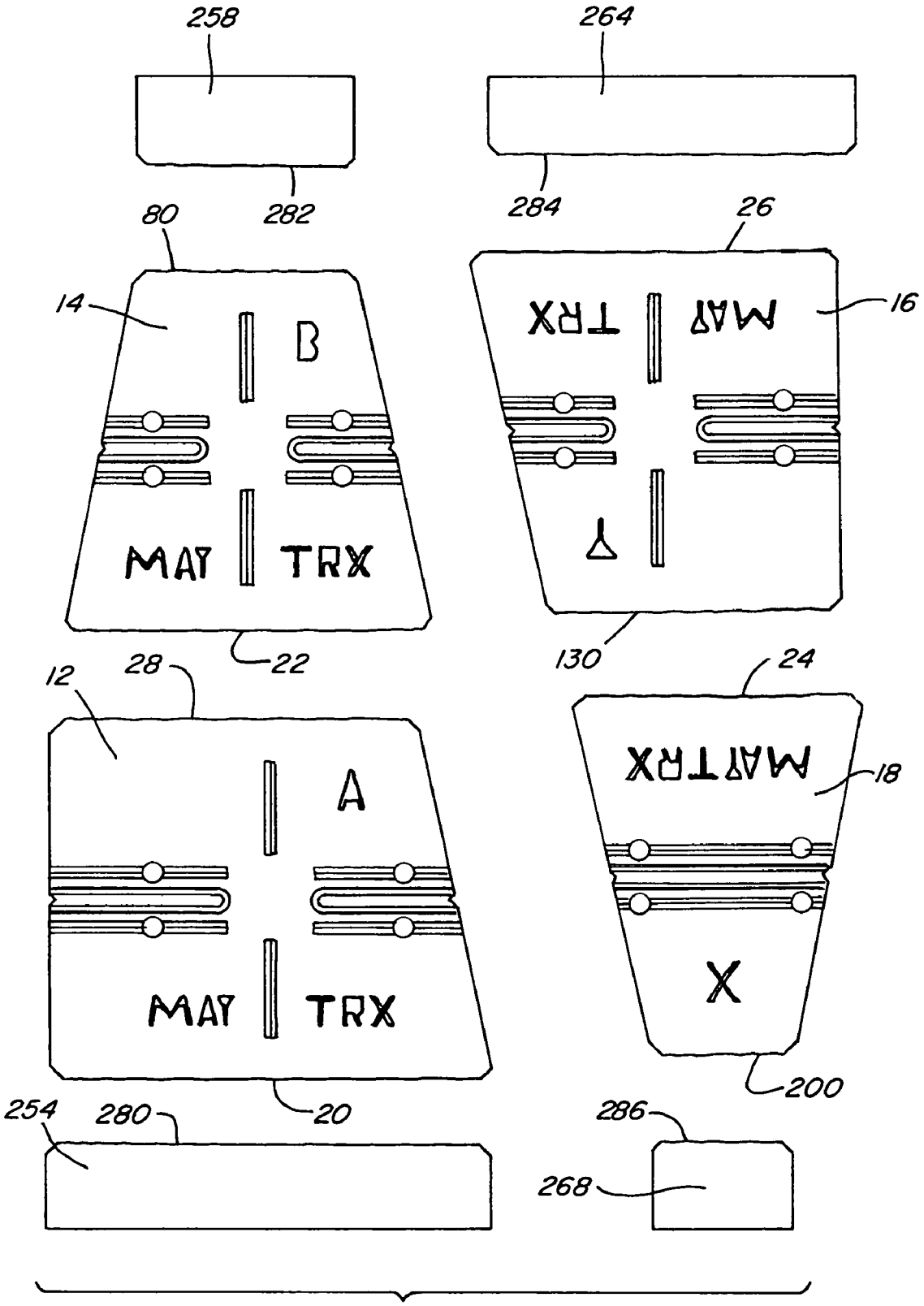
FIG. 11 is a top view of the first, second, third, and fourth blocks and the pavers shown in FIG. 10 being split apart.

FIG. 11 illustrates the blocks 12, 14, 16, and 18, and the pavers 254, 258, 264, and 268 being split apart. Splitting the block 12 and the block 14 along the score line 252 forms the split faces 22 and 28. The split face 22 is about as wide as the split face 28. Once the block 16 and 18 are split along the score line 262 the split faces 24 and 130 are created. The split face 24 is also about as wide as the split face 130. The paver 254 is split from the first block 12 to form the split face 20 and a split face 280. The paver 258 is split apart from the second block 14 to create the split face 80 and a split face 282 on the paver 258. The paver 264 is split from the third block 16 to form the split face 26 and a split face 284. Also, the paver 268 is split away from the fourth block 18 to produce the split face 200 and a split face 286.

Some possible standard dimension for the blocks 12, 14, 16, and 18 are as follows. The first block 12 or the "A" block may be six inches tall, ten inches deep, and have a front face 20 that is twelve inches wide and a back face 28 that is ten inches wide. The second block 14 or the "B" block may be six inches tall, ten inches deep, and have a front face 22 that is ten inches wide and a back face 80 that is six inches wide. The third block 16 or the "Y" block may be six inches tall, ten inches deep, and have a front face 24 that is ten inches wide and a back face 130 that is eight inches wide. The fourth block 18 or the "X" block may be six inches tall, ten inches deep, have a front face 26 that is eight inches wide and a back face 200 that is four inches wide. All of these dimensions may be normalized to about 98% due to production constraints in some areas. It is also possible and contemplated to have all of the blocks 12, 14, 16, and 18 be only four inches tall. When blocks are constructed in with this particular dimension, the blocks will not include any passages and the offset pockets will be as deep as the shallow grooves.

Figure 12:
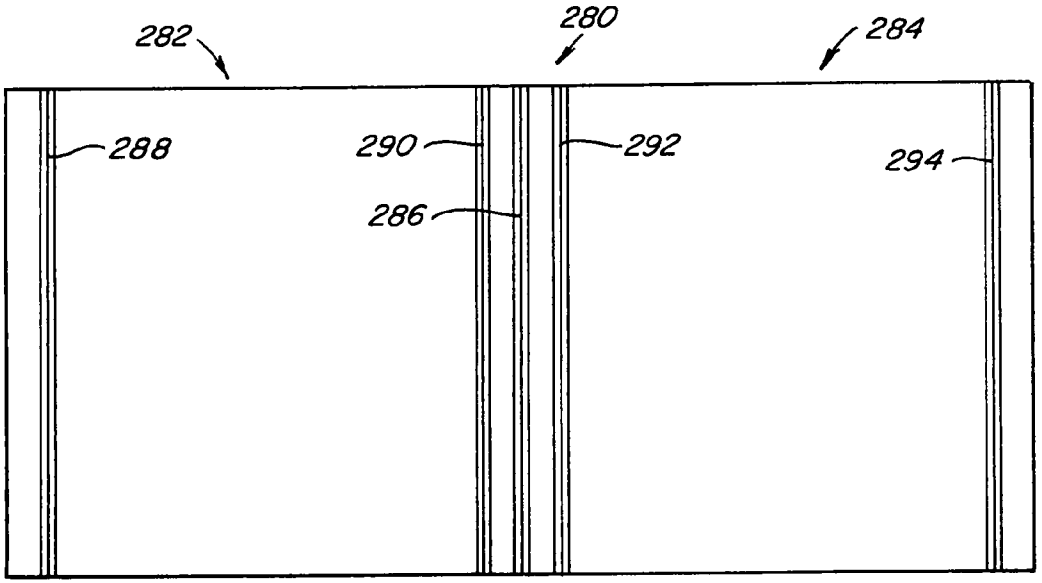
FIG. 12 is a top view of a modular block that is used to form two capstones for the modular block system of the present invention.
Figure 13:
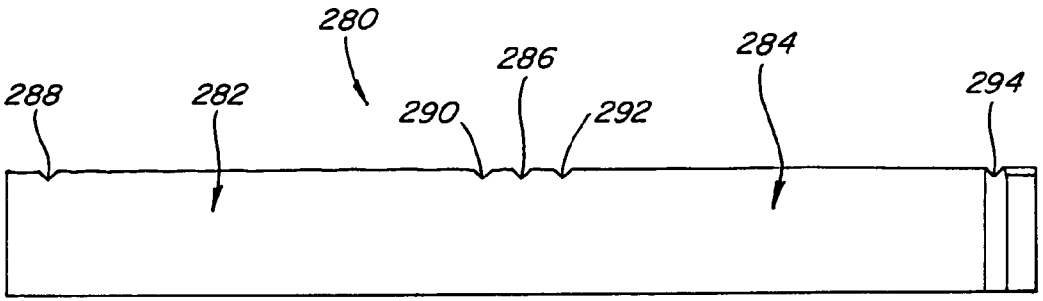
FIG. 13 is a side view of the modular block shown in FIG. 12.

With reference now to FIG. 12, a top view of a modular block 280 is shown that is used to produce two capstones 282 and 284 to be used in the modular block system 10. The block 280 has a central score line 286 that is used to split the block 280 into the two capstones 282 and 284. The capstone 282 has a pair of score lines 288 and 290 that may be used to produce split faces for the capstone 282. The capstone 284 also has a pair of score lines 292 and 294 that may be used to create split faces for the capstone 284. A side view of the modular block 280 is depicted in FIG. 13. Some typical dimensions for the capstones 282 and 284 may be twelve inches wide by eleven inches deep by three inches thick. The capstones 282 and 284 are deeper than the blocks 12, 14, 16, and 18. The capstones 282 and 284 are deeper to provide a one inch overhang when the capstones 282 and 284 are used to cap any structure made with the blocks 12, 14, 16, and 18. Further, the capstones 282 and 284 may be used as a soldier stone in a structure, as will be shown further herein. Also, when the capstones 282 and 284 are used as a soldier stone, this provides a three dimensional effect to a structure. The modular block 280 may have the dimension of twenty-six inches wide by twelve inches deep by three inches thick. As can be appreciated, the modular block 280 may be formed by the same materials described above with reference to the blocks 12, 14, 16, and 18 and constructed using the same described methods. Further, a mold box (not shown) may be used to form the block 280 therein.

Figure 14:
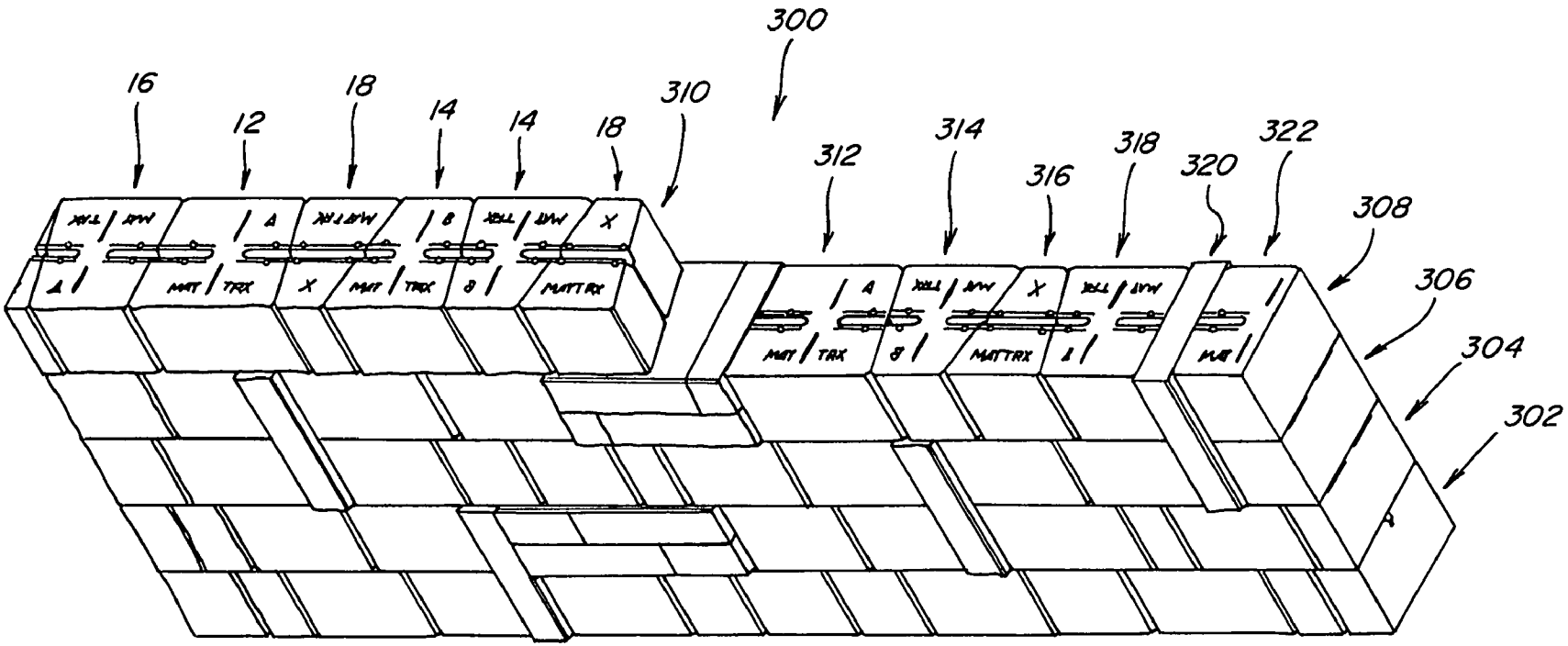
FIG. 14 is a partial perspective view of a wall constructed with the modular block system of the present invention.

FIG. 14 shows a freestanding wall structure 300 which may be constructed using the modular block system 10 of the present invention. The freestanding wall structure 300 may be formed using a number of individual courses 302, 304, 306, 308, and 310 of the blocks 12, 14, 16, 18, 282, and 284 to build the structure 300 to any given height. The blocks 12, 14, 16, 18, 282, and 284 may be stacked on top of each other to form the wall structure 300. For example, the course 310 consists of a fourth block 18 next to a second block 14 next to a second block 14 next to a fourth block 18 next to a first block 12 next to a third block 16. For further variation in the appearance of the structure 300, the course 308 may consist of a first stone or "A" stone 312 next to a second stone or "B" stone 314 next to a fourth stone or "X" stone 316 next to a third stone or "Y" stone 318 next to a capstone 320 next to a split "A" stone 322. The split "A" stone 322 is a first stone 12 that has been split using the score lines 42 and 44. The capstone 320 is used in a vertical position as a soldier stone. Also, since the capstone 320 has a dimension of eleven inches, the capstone 320 sticks out from the other blocks, for example blocks 312, 314, 316, 318, and 322, to create a three dimensional effect or a more natural look to the structure 300.

Construction of the wall 300 is accomplished by using known construction methods. For example, a trench area may be excavated which approximates the size of the blocks 12, 14, 16, 18, 282, 282, and 322. Footing material may be placed into the trench area to be compacted and leveled. The first layer or course 302 of the blocks 12, 14, 16, 18, 282, 284, and 322 are then laid into the trench and then the ensuing individual course 304 of the blocks 12, 14, 16, 18, 282, 284, and 322 is laid on top of the first course 302. Although not shown, to finish the wall structure 300, a top or cap row or course may be formed by placing capstones 282 and 284 over the course 310. Additionally, if the wall structure is an engineered retaining wall, it is known to use material such as geogrid to help hold the soil retained by the wall in place. In this situation, the passages 54, 56, 62, 64, 106, 108, 114, 116, 156, 158, 164, 166, 220, 222, 224, and 226 may have a rod or pin inserted therein and the geogrid material, which includes holes, can be placed through the rod or pin. This helps to keep the geogrid in place and the weight of the blocks 12, 14, 16, 18, 282, 284, and 322 also help to hold the geogrid material in place. Also, if the wall structure is a retaining wall, then each course will be setback by using the pockets 46, 48, 98, 100, 148, 150, and 214 provided in each of the blocks 12, 14, 16, and 18.

Figure 15:
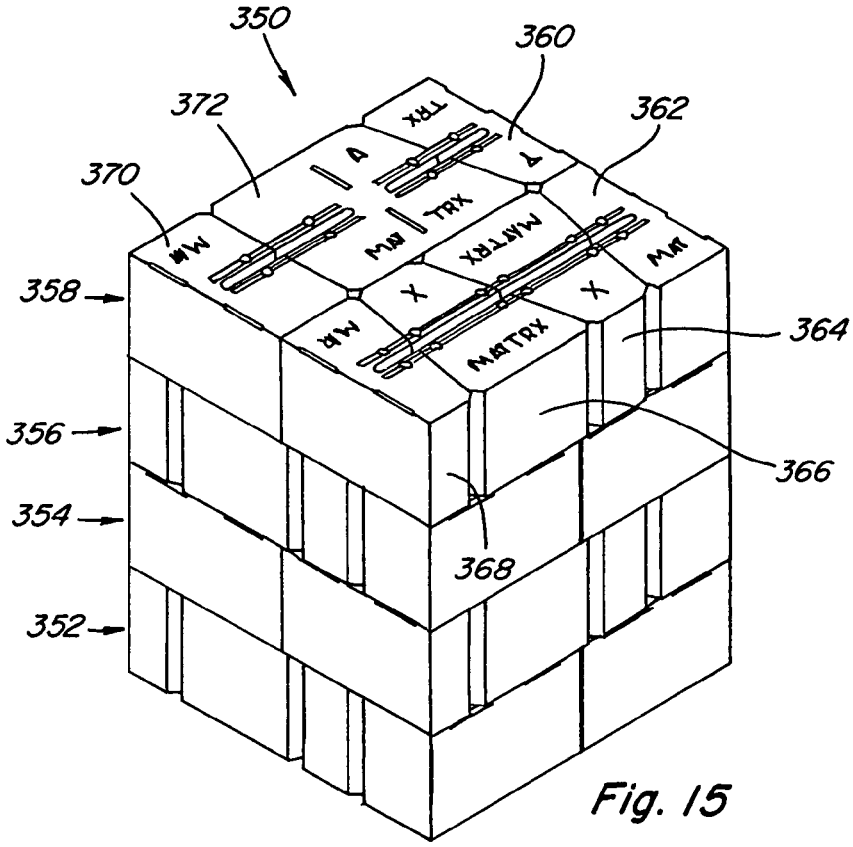
FIG. 15 is a perspective view of a column structure constructed with the modular block system of the present invention.

FIG. 15 shows a perspective view of a column 350 being constructed using the modular block system 10 of the present invention. The column 350 is formed by constructed four courses 352, 354, 356, and 358. The course 358 is shown to include a "Y" block 360 that has been split, another "Y" block 362 that has been split, a "X" block 364, another "X" block 366, a "B" block 368 that has been split, another "B" block 370 that has been split, and an "A" block 372. In this manner the course 358 is square and has dimension of twenty inches by twenty inches. Further, the height of the four courses 352, 354, 356, and 358 is twenty-four inches or two feet. All of the blocks 360, 362, 364, 366, 368, 370, and 372 in the course 358 have split faces showing. Other dimensions and shapes for the column 350 are possible and contemplated.

Figure 16:
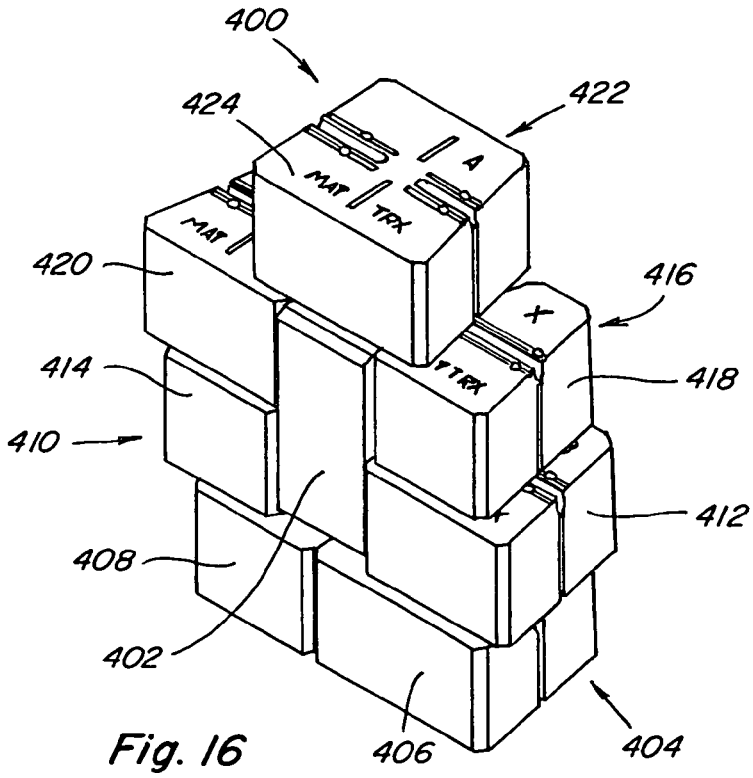
FIG. 16 is a perspective view of a structure constructed using one of the blocks of the modular block system as a soldier stone.

Referring now to FIG. 16, an example of a structure 400 is illustrated in which an "A" block 402 is used as a soldier block or stone in the structure 400. The structure 400 may be constructed by forming a first course 404 consisting of an "A" block 406 and a "Y" block 408. The soldier stone 402 is then placed on the first course 404 in a vertical orientation. A second course 410 consisting of a "B" block 412 and a "X" block 414 are placed on the first course 404 next to butt up against the soldier stone 402. A third course 416 is constructed by using a "X" block 418 and a "B" block 420. The third course 416 is placed over the second course 410 and also butts up against the soldier stone 402. A fourth course 422 consists of an "A" block 424 placed over the soldier stone 402 and the blocks 418 and 420 that form the third course 416. All of the courses 404, 410, 416, and 422 have split faces.

Figure 17:
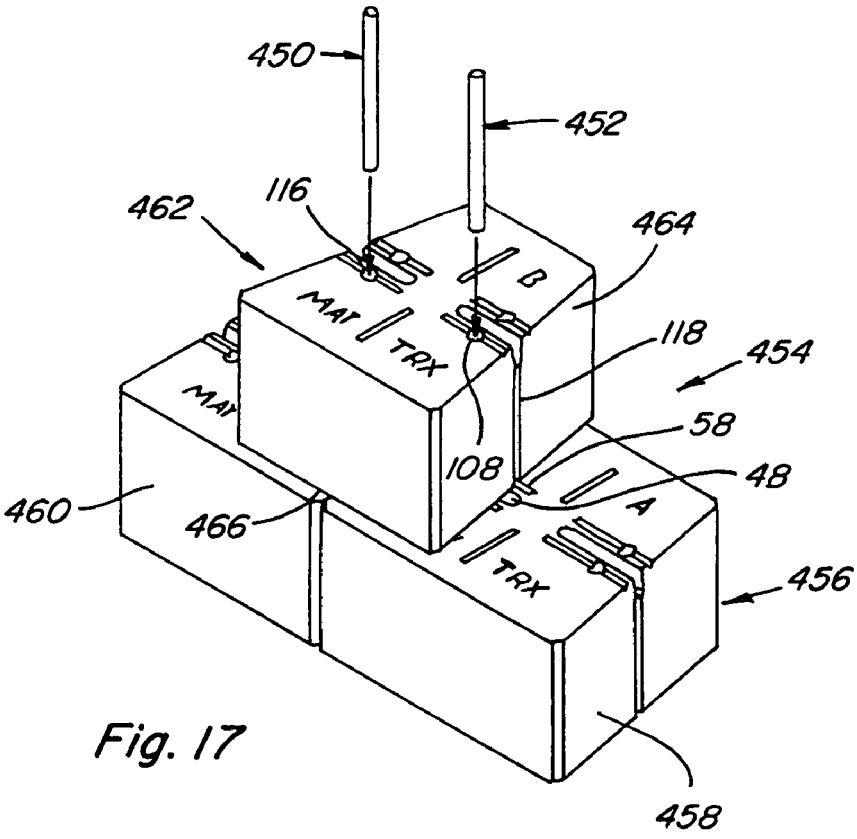
FIG. 17 is a perspective view of a structure constructed with the modular block system of the present invention using pins.

FIG. 17 depicts how rods or pins 450 and 452 may be used with the modular block system 10. A structure 454 is constructed by forming a first course 456 that consists of an "A" block 458 and a "Y" block 460. A second course 462 that includes a "B" block 464 is placed over the first course 456. The pin 452 is inserted into the passage 108 to pass through the block 464 to be captured in the offset pocket 48 of the block 458. In particular, if the pin 452 is six and a half inches long and the block 458 is six inches thick then about a half inch of the pin 452 will be lodged or captured in the pocket 48. The alignment groove 118 is used to align the groove 118 of the block 464 with the shallow groove 58 of the block 458. The pin 450 is inserted into the passage 116 to pass through the block 464 into the offset pocket 148 (not shown) of the block 460. The pocket 148 is not visible or shown due to the block 464 covering the pocket 148. By using the pins 450 and 452 and the passages 108 and 116 and the offset pockets 46 and 48, the block 464 of the second course 462 is offset or setback a distance 466 from the first course 456. An example of the setback may be three quarters of an inch.

Figure 18:
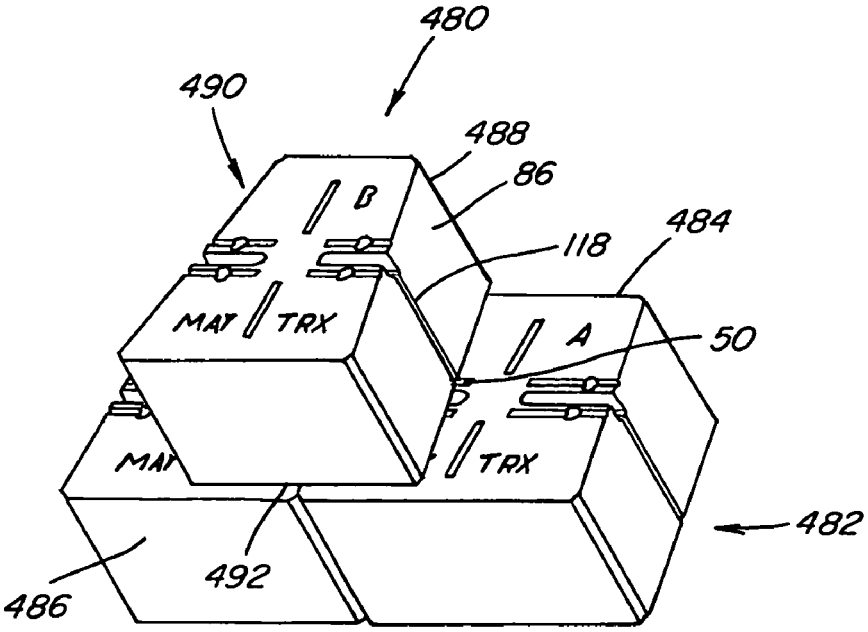
FIG. 18 is a perspective view of a structure constructed with the modular block system of the present invention using an alignment groove.

With reference to FIG. 18, a structure 480 is shown that is constructed using the alignment grooves of the blocks 12, 14, 16, and 18. The structure 480 consists of a first course 482 having an "A" block 484 and a "Y" block 486. Stacked on the first course 482 is a "B" block 488 that serves as a second course 490. The alignment groove 118 in the first side 86 of the block 488 is visually aligned with the groove 50 of the block 482. Although not shown, the alignment groove associated with the second side 88 of the block 488 is visually aligned with the groove 152 of the block 486. In this manner, the block 488 may be offset or setback a distance 492 from the first course 482.

As can be appreciated, the modular block system 10 of the present invention may be used for both commercial and residential use in building various landscape structures. Numerous other designs or shapes for various landscaping structures may be formed by using the blocks 12, 14, 16, 18, 282, and 284. Further, instructions for a particular project may be shipped with the blocks 12, 14, 16, 18, 282, and 284. By using the indicators 38, 90, 140, and 210, an individual will be able to construct a structure quickly and easily. Also, the markings 40, 92, 142, and 212 insure that the correct modular block system 10 is being used.

Other advantages associated with the use of the modular block system 10 include the reduced number of different components or parts that need to be manufactured, transported, stored, or inventoried. Since the mold box 250 can yield at least four different blocks from a single mold, manufacturing costs are significantly reduced. In particular, only two molds are required which can greatly reduce manufacturing costs. The modular block system 10 is also easy to install or build with and various landscaping projects or structures may be built using the modular block system 10. Examples of other landscaping projects or applications which may be constructed using the modular block system 10 include circle planter boxes, tree rings, BBQ pits, tetra ponds, steps, free standing walls, raised patios, patio barrier walls, fence posts, and stone fences.

Another particular aspect of the modular block system 10 is that the blocks 12, 14, 16, and 18 may be tumbled to give a natural appearance to the blocks. Once the blocks 12, 14, 16, and 18 are formed and split, the resulting blocks 12, 14, 16, and 18 are put into a machine that tumbles the blocks 12, 14, 16, and 18 together. After the tumbling process is complete, the blocks 12, 14, 16, and 18 may be used in the same manner as above described. Tumbling enhances the appearance of the blocks 12, 14, 16, and 18 and this allows the blocks to be sold at a premium. Further, the capstones 282 and 284 and the split off pavers 254, 258, 264, and 268 may be tumbled in the same manner.

From all that has been said, it will be clear that there has thus been shown and described herein a modular block system which fulfills the various objects and advantages sought therefor. It will become apparent to those skilled in the art, however, that many changes, modifications, variations, and other uses and applications of the subject modular block system are possible and contemplated. All changes, modifications, variations, and other uses and applications which do not depart from the spirit and scope of the invention are deemed to be covered by the invention, which is limited only by the claims which follow.

What is claimed is:

1. A modular block system comprising a first block, a second block, a third block, a fourth block, and a capstone, the first block having a front face, a back face, a first side, a second side, a top having a first indicator and a marking formed in the top, and a bottom, with the front face being wider than the back face and the first side being slanted from the front face toward the back face and the second side being straight from the front face to the back face, the second block having a front face, a back face, a first side, a second side, a top having a second indicator and a marking formed in the top with the second indicator being different than the first indicator, and a bottom, with the front face being wider than the back face and the first and second sides being slanted from the front face toward the back face, the third block having a front face, a back face, a first side, a second side, a top having a third indicator formed in the top with the third indicator being different than the first indicator and the second indicator, and a bottom, with the front face being wider than the back face and the first side being slanted from the front face toward the back face, and the fourth block having a front face, a back face, a first side, a second side, a top having a fourth indicator formed in the top with the fourth indicator being different than the first indicator, the second indicator, and the third indicator, and a bottom, with the front face being wider than the back face and the first side and the second side being from the front face toward the back face, the first, second, third, and fourth blocks each having a marking formed in their respective tops with each marking being the same and each marking identifying a name of the modular block system, the first, second, third, and fourth indicators being used to construct a structure based on installation instructions with the instructions indicating where the first, second, third, and fourth blocks may be placed to construct the structure.

2. The modular block system of claim 1 wherein the first block, the second block, and the third block each comprise a pair of score lines for splitting the blocks with the pair of score lines spanning a portion of each of the tops.

3. The modular block system of claim 2 wherein the score lines are centered on each of the front faces.

4. The modular block system of claim 1 wherein the first block, the second block, the third block, and the fourth block each have an offset pocket in each of the tops.

5. The modular block system of claim 4 wherein the first block, the second block, the third block, and the fourth block have a pair of grooves on either side of the offset pocket with the pair of grooves extending a portion of each of the tops of the first block, the second block, the third block, and the fourth block.

6. The modular block system of claim 5 wherein the first block, the second block, the third block, and the fourth block have a passage in each of the grooves.

7. The modular block system of claim 6 wherein each passage spans the length of the first sides.

8. The modular block system of claim 1 wherein each front face and back face has a split face surface.

9. The modular block system of claim 1 wherein the back face of the first block has a width and the front face of the second block has a width and the width of the back face of the first block is equal to the width of the front face of the second block.

10. A modular block system comprising a first block, a second block, a third block, a fourth block, and a paver associated with each of the blocks, the first block having a front face, a back face, a first side, a second side, a top, and a bottom, a first indicator formed in the top, with the front face being wider than the back face and the first side being slanted from the front face toward the back face and the second side being straight from the front face to the back face, the second block having a front face, a back face, a first side, a second side, a top, and a bottom, a second indicator formed in the top with the second indicator being different than the first indicator, with the front face being wider than the back face and the first and second sides being slanted from the front face toward the back face, a score line between the back face of the first block and the front face of the second block with the score line for splitting the first and the second blocks apart, the third block having a front face, a back face, a first side, a second side, a top, and a bottom, a third indicator formed in the top with the third indicator being different than the first indicator and the second indicator, with the front face being wider than the back face and the first side being slanted from the front face toward the back face, and the fourth block having a front face, a back face, a first side, a second side, a top, and a bottom, a fourth indicator formed in the top with the fourth indicator being different than the first indicator, the second indicator, and the third indicator, with the front face being wider than the back face and the first side and the second side being from the front face toward the back face, a score line between the back face of the third block and the front face of the fourth block with the score line for splitting the third and the fourth blocks apart, with the first indicator identifying the first block, the second indicator identifying the second block, the third indicator identifying the third block, and the fourth indicator identifying the fourth block, the first, second, third, and fourth indicators being used to construct a structure based on installation instructions with the instructions indicating where the first, second, third, and fourth blocks may be placed to construct the structure.

11. The modular block system of claim 10 wherein each of the first, second, third, and fourth blocks further comprise a marking formed in each of the tops.

12. The modular block system of claim 11 wherein the markings are the same.

13. The modular block system of claim 10 wherein each of the indicators is an alphabetic indicator.

14. A modular block system comprising a first block, a second block, a third block, a fourth block, and a capstone, the first block having a front face, a back face, a first side, a second side, a top having a first indicator formed in the top, and a bottom, an alignment groove spanning the first side, with the front face being wider than the back face and the first side being slanted from the front face toward the back face and the second side being straight from the front face to the back face, the second block having a front face, a back face, a first side, a second side, a top having a second indicator formed in the top, and a bottom, an alignment groove spanning the first side, with the front face being wider than the back face and the first and second sides being slanted from the front face toward the back face, the third block having a front face, a back face, a first side, a second side, a top having a third indicator formed in the top, and a bottom, an alignment groove spanning the first side, with the front face being wider than the back face and the first side being slanted from the front face toward the back face, and the fourth block having a front face, a back face, a first side, a second side, a top having a fourth indicator formed in the top, and a bottom, an alignment groove spanning the first side, with the front face being wider than the back face and the first side and the second side being from the front face toward the back face, with the first indicator identifying the first block, the second indicator identifying the second block, the third indicator identifying the third block, and the fourth indicator identifying the fourth block, the first, second, third, and fourth blocks each having a marking formed in their respective tops with each marking being the same and each marking identifying a name of the modular block system, the first, second, third, and fourth indicators being used to construct a structure based on installation instructions with the instructions indicating where the first, second, third, and fourth blocks may be placed to construct the structure.

15. The modular block system of claim 14 wherein the first block, the second block, the third block, and the fourth block each have an offset pocket in each of the tops and each of the alignment grooves is aligned with the offset pockets.

16. The modular block system of claim 15 wherein the first block, the second block, and the third block have a pair of grooves on either side of the offset pocket and the alignment groove of one block being capable of being aligned with one of the grooves of another block with the pair of grooves extending a portion of each of the tops of the first block, the second block, and the third block.

17. The modular block system of claim 16 wherein the first block, the second block, the third block, and the fourth block have a passage in each of the grooves, each passage runs through each block, and a pin capable of being inserted into each passage of one block to be captured by an offset pocket of another block.

18. A landscaping structure constructed from a modular block system comprising a first block, a second block, a third block, a fourth block, and a capstone, the first block having a front face, a back face, a first side, a second side, a top having a first indicator formed in the top, and a bottom, with the front face being wider than the back face and the first side being slanted from the front face toward the back face and the second side being straight from the front face to the back face, the second block having a front face, a back face, a first side, a second side, a top having a second indicator formed in the top with the second indicator being different from the first indicator, and a bottom, with the front face being wider than the back face and the first and second sides being slanted from the front face toward the back face, the third block having a front face, a back face, a first side, a second side, a top having a third indicator formed in the top with the third indicator being different from the first indicator and the second indicator, and a bottom, with the front face being wider than the back face and the first side being slanted from the front face toward the back face, and the fourth block having a front face, a back face, a first side, a second side, a top having a fourth indicator formed in the top with the fourth indicator being different from the first indicator, the second indicator, and the third indicator, and a bottom, with the front face being wider than the back face and the first side and the second side being from the front face toward the back face, the first, second, third, and fourth blocks each having a marking formed in their respective tops with each marking being the same and each marking identifying a name of the modular block system, the first, second, third, and fourth indicators being used to construct the landscaping structure based on installation instructions with the instructions indicating where the first, second, third, and fourth blocks may be positioned to construct the landscaping structure.

19. The landscaping structure of claim 18 wherein the back face has a width and the front face of the second block has a width and the width of the back face of the first block is equal to the width of the front face of the second block.

20. The landscaping structure of claim 18 wherein the back face of the third block has a width and the front face of the fourth block has a width with the width of the back face of the third block is equal to the width of the front face of the fourth block.

* * * * *